US006312105B1

(12) United States Patent
Miyauchi

(10) Patent No.: US 6,312,105 B1
(45) Date of Patent: Nov. 6, 2001

(54) RECORDING APPARATUS

(75) Inventor: Yasuo Miyauchi, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/426,130

(22) Filed: Oct. 25, 1999

(30) Foreign Application Priority Data

Oct. 27, 1998 (JP) ..... 10-306137

(51) Int. Cl.[7] ..... B41J 2/14
(52) U.S. Cl. ..... 347/49
(58) Field of Search ..... 347/49, 86, 87, 347/50

(56) References Cited

U.S. PATENT DOCUMENTS 5,552,816 * 9/1996 Oda et al. ..... 347/86
5,619,239 * 4/1997 Kotaki et al. ..... 347/86
5,748,210 * 5/1998 Watanabe et al. ..... 347/50
6,102,533 * 8/2000 Nozawa et al. ..... 347/86

FOREIGN PATENT DOCUMENTS 0 710 568 5/1996 (EP) .
0 846 560 6/1998 (EP) .
1-125238 5/1989 (JP) .

* cited by examiner

*Primary Examiner*—N. Le
*Assistant Examiner*—Michael Nghiem
(74) *Attorney, Agent, or Firm*—Fitzpatrick, Cella, Harper & Scinto

(57) ABSTRACT

A head cartridge is positioned within a carriage by a positioning protrusion on both sides of the head cartridge being fitted into a positioning groove of the carriage. The head cartridge is secured by an inclined surface of the upper portion of the rear surface being pressed with a press-contacting roller of a locking lever. The locking lever is provided with a pressing member which presses the rear surface of the head cartridge by the rotation of the locking lever during the operation of removing the cartridge. An auxiliary engagement portion and an auxiliary guide, which contact only during attachment and detachment operations of the head cartridge to restrict the attachment and detachment locuses, are provided in the head cartridge and the carriage, respectively.

11 Claims, 7 Drawing Sheets

RECORDING APPARATUS

BACKGROUND OF THE INVENTION

1. Field of the Invention

The present invention relates to a recording apparatus having a detachable cartridge, and more particularly relates to the attachment and detachment mechanism of a cartridge.

2. Related Background Art

As attachment and detachment mechanisms of a head cartridge provided for an ink jet recording apparatus, a reference pad, a contact pad, and a shelf-shaped member have been provided on the side of a head cartridge, the rear thereof, and the upper section of the rear thereof, respectively, and the head cartridge is secured onto a given position of a carriage by Press-contacting the shelf-shaped member with a snap-spring, as described in Japanese Laid-Open Patent Application No. 1-125238. According to these mechanisms, the head cartridge can be attached and detached and at the same time can be electrically connected.

However, in the above-mentioned conventional examples, there were the following problems.

When the head cartridge is attached or detached, it is rotated or pivoted around the reference pad. Therefore, the head cartridge easily interferes with a platen or a spur placed in the vicinity of the cartridge. When a concave relief portion is provided in the platen or the position of the spur is significantly relieved, to prevent this interference, waving of the recording paper is increased for example and a state of holding the recording paper is deteriorated, resulting in deterioration of images.

Thus, a device is known, which can attach and detach a head cartridge at the area other than the paper path, where a spur and the like are not provided. For this device, when a user carelessly moves a carriage during an operation of attachment or detachment of the head cartridge, an interfering portion is generated and a head cartridge or a spur is possibly broken.

Further, when an ink tank replaceable head cartridge is used, only the ink tank is replaced with the head cartridge being, of course, secured to the carriage. Then, when a force required for setting the ink tank is imparted, the snap-spring becomes dislodged. Therefore, the head cartridge must be secured again. To increase the snap-spring loading force to prevent this requires a very large operating force for securing the head cartridges.

SUMMARY OF THE INVENTION

In consideration of the foregoing problems, an object of the present invention is to provide head a cartridge attaching and detaching mechanisms with does not interfere with a platen or a carrying rotator in the vicinity of the cartridge and has an excellent operability when the head cartridge is attached or detached, and a recording apparatus provided with the mechanism.

Another object of the present invention is to provide a head cartridge attaching and detaching mechanism, in which when an ink tank replaceable head cartridge is used, the head cartridge is not dislodged during the replacement of the ink tank, and a recording apparatus provided with the mechanism.

Still another object of the present invention is to provide a recording apparatus including a carriage, which detachably holds a cartridge, wherein the carriage has a positioning portion on both sides and an inclined surface on the upper section of the rear surface; the carriage has positioning portions which engage with the positioning portions on both sides of the cartridge, and has a locking lever which is rotatable on the upper portion of the cartridge and secures the cartridge within the carriage by pressing the inclined surface in accordance with one-directional rotation of the locking lever; a pushing member for detaching the cartridge by pushing the upper portion of the rear surface of the cartridge in accordance with the rotation of the locking lever for securing the cartridge and the opposite-directional rotation, is provided with the locking lever; and an auxiliary engagement portion for restricting the attachment and detachment paths of the cartridge by contacting the auxiliary engagement portion during only the attachment and detachment operations of the cartridge, is provided with both of the cartridge and the carriage.

Still another object of the present invention is to provide an ink jet recording apparatus including a carriage which detachably holds a head cartridge for discharging ink liquid droplets to record, wherein the head carriage has a positioning portion on both sides and an inclined surface on the upper portion of the rear surface, and further possesses a detachable ink tank; the carriage has positioning portions which engage with the positioning portions on both sides of the head cartridge, and has a locking lever which is rotatable on the upper portion of the head cartridge and secures the head cartridge within the carriage by pressing the inclined surface in accordance with one-directional rotation of the locking lever; and an auxiliary engagement portion for preventing the head cartridge from being rotated by the operating force without limitation using the positioning portions as the fulcrum, is provided with both of the head cartridge and the carriage.

Still another object of the present invention is to provide an ink tank-holding holder which is held within a carriage housing and is held under detachable conditions from the housing by engagement of the operating portion of the carriage, wherein the holder has an inclined surface for shifting the holder upwardly while sliding the carriage operating portion; an engagement surface which is at the edge of the inclined surface and engages by engagement with the carriage operating portion; and an operating portion which protrudes from the housing by inclination of the holder with respect to the housing with the carriage operating portion.

Still another object of the present invention is to provide a carriage which can detach the above-mentioned holder, wherein the carriage operating portion has a pushing member for shifting the holder upwardly while being slided on the inclined surface of the holder; an engagement surface which is the end portion of the pressing member and engages with the engagement surface of the holder; and a pressing portion which imparts a pressing force to the receiving portion of the upper surface of the holder.

Still another object of the present invention is to provide an ink jet recording apparatus including the above-mentioned carriage.

DETAILED DESCRIPTION OF THE PREFERRED EMBODIMENTS

Embodiments of the present invention will be described below with reference to drawings.

(First Embodiment)

Figure 1:
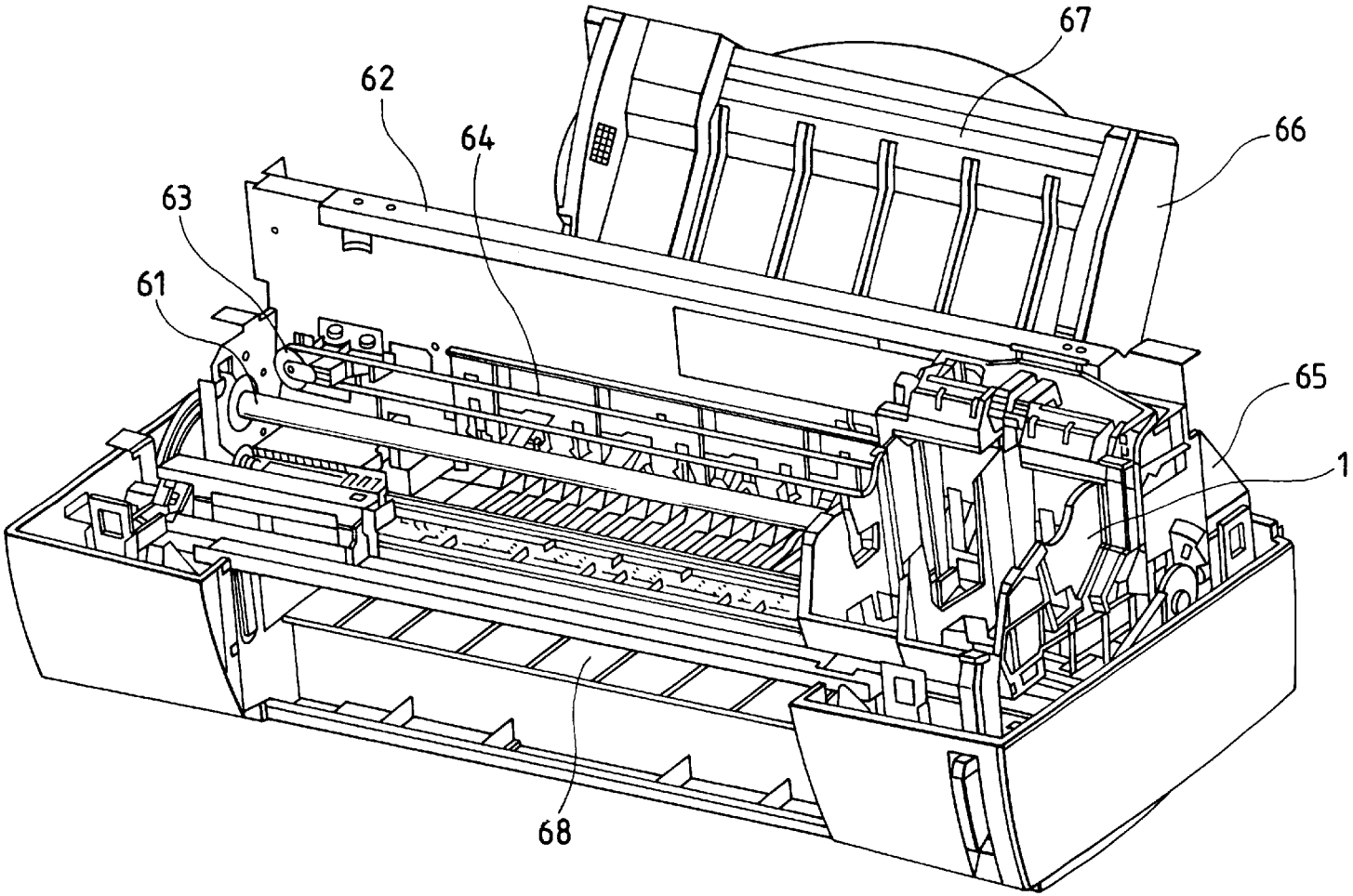
FIG. 1 is a perspective view showing the whole configuration of an ink jet recording apparatus according to an embodiment of the present invention.

FIG. 1 is a perspective view showing the whole configuration of an ink jet recording apparatus according to a first embodiment of the present invention.

The ink jet recording head shown in FIG. 1 includes a carriage 1 which mounts a head cartridge as recording means and can be reciprocated along a recording material (not shown). The carriage 1 is guided and supported by a guide shaft 61 and a guide rail 62 in the main scanning direction. An endless timing belt 64 is wound around a pulley 63 provided at one end of the device housing and a pulley (not shown) provided at the other end of the device housing. The timing belt 64 is connected to the carriage 1 and can be driven with a motor 65 through a pulley, gear, and the like.

Further, the present ink jet recording apparatus has an automatic paper feeder 66. Recording materials (not shown) stacked on a paper feed tray 67 are supplied by the automatic paper feeder 66 one by one. The supplied recording materials are carried through the recording portion and discharged from a paper discharge port 68 to the outside of the device. When a recording material is conveyed by one line, ink is discharged from nozzle portions of a head cartridge and recording is carried out, while the carriage 1 is scanned along the guide shaft 61 in the recording portion.

Figure 2:
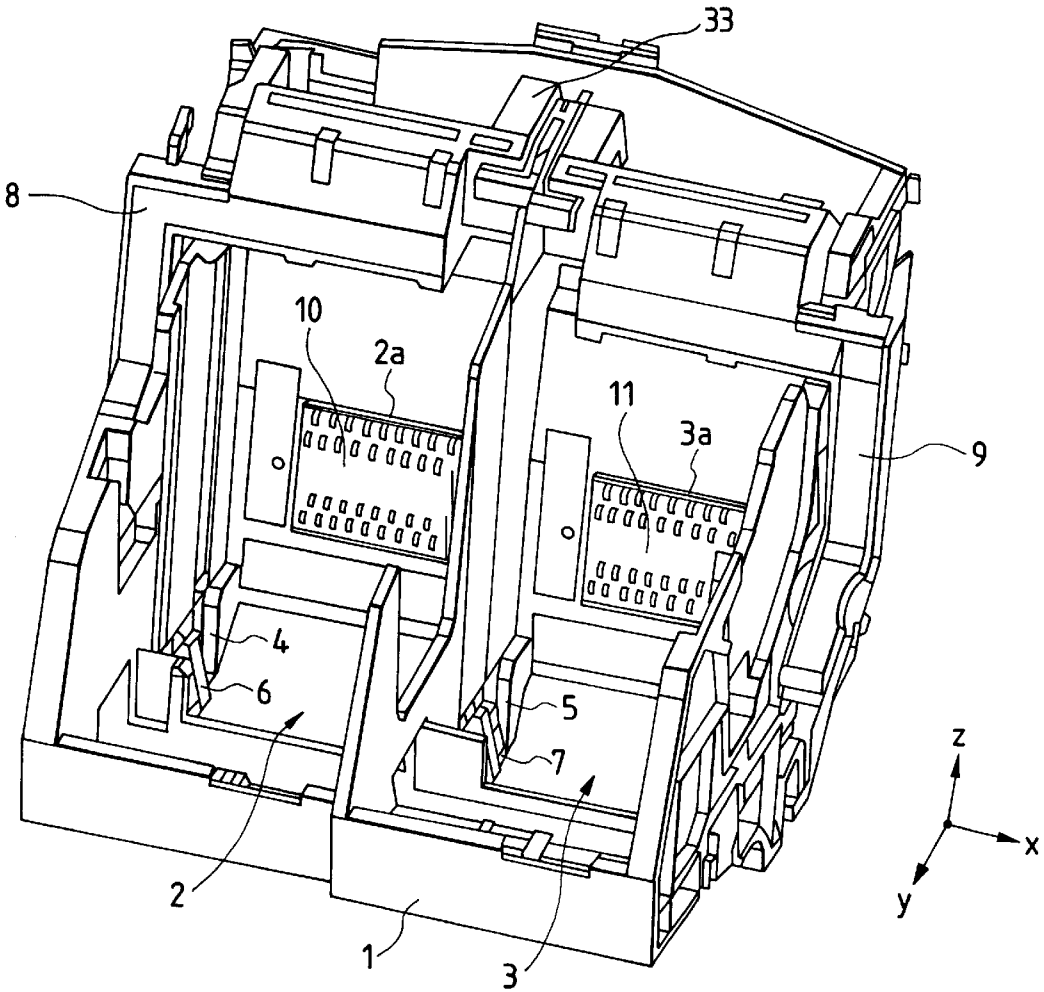
FIG. 2 is a perspective view showing the detailed structure of the carriage shown in FIG. 1.
Figure 3:
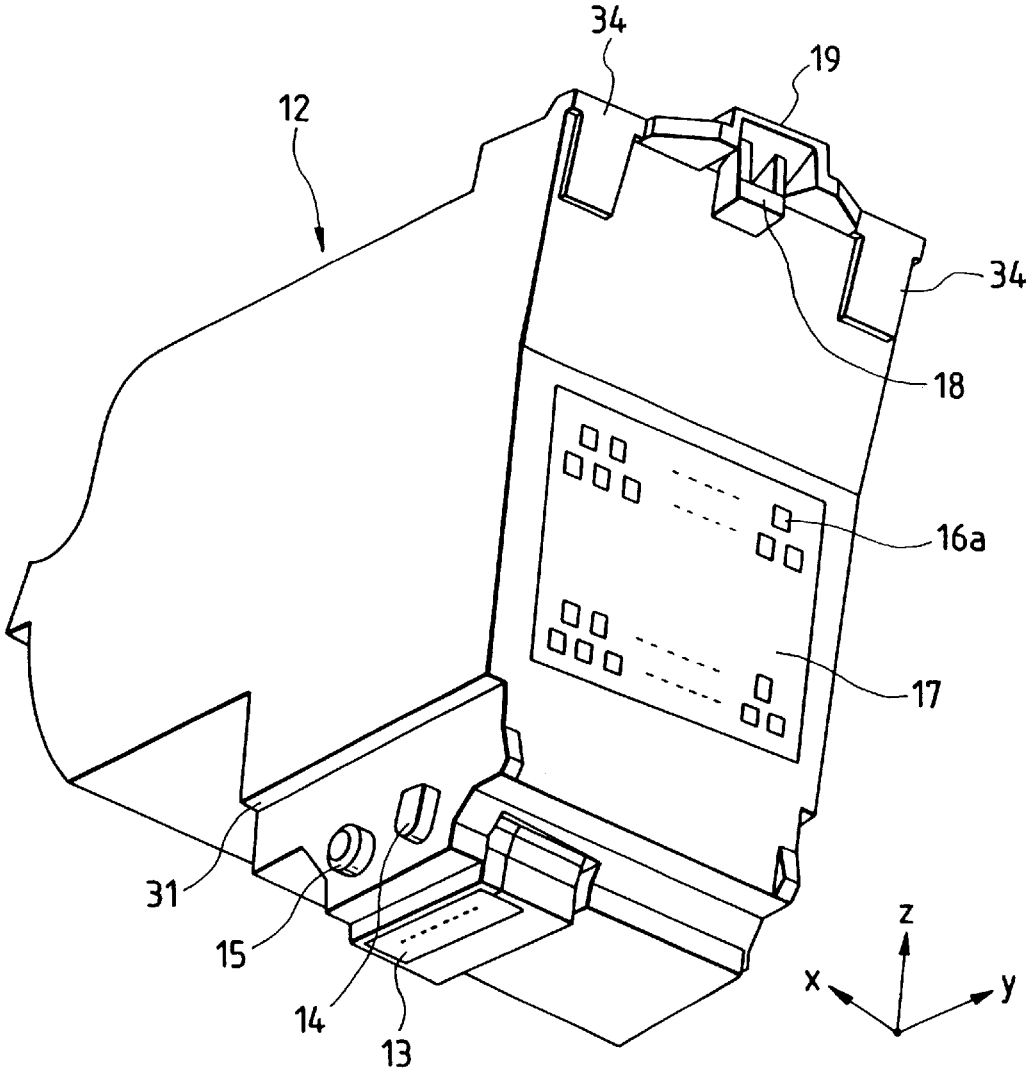
FIG. 3 is a perspective view showing the detailed structure of the head cartridge which is mounted on the carriage shown in FIG. 1.

FIG. 2 is a perspective view showing the detailed structure of the carriage 1, and FIG. 3 is a perspective view showing the detailed structure of the head cartridge which is mounted on the carriage shown in FIG. 1.

The carriage 1 shown in FIG. 2 is provided with a pocket 2 for mounting a black cartridge, and a pocket 3 for mounting a color cartridge. Two grooves 4 for positioning the black cartridge are formed on both sides of the pocket 2. Similarly, two grooves 5 for positioning the color cartridge are formed on both sides of the pocket 3. The pockets 2 and 3 are provided with plate springs 6 and 7 for abutting the head cartridges in a direction x, respectively. Further, the upper portion of the carriage 1 is provided with rotatable locking levers 8 and 9 in correspondence to the respective pockets 2 and 3. Connectors 10 and 11 are secured so that they are slightly protruded from openings 2*a* and 3*a* of the pockets 2 and 3 on the rear surface of the carriage. Incidentally, the above-mentioned locking lever is an operating portion of the carriage, which functions as a lever with which an operator removes the head cartridge (or the head holder) from the carriage.

On the other hand, as shown in FIG. 3, a head cartridge (or a head holder) 12, which is mounted on the carriage 1, includes a nozzle portion 13 on the lower surface of the cartridge, positioning protrusions 14 on both sides thereof, and a abutting portion 15 in an direction x on one side of the cartridge. Further, many contact pads 16*a* forming power switch board 17 are fixed to the rear surface of the cartridge. Furthermore, on the upper portion of the rear surface of the cartridge are formed an abutting portion 18 in a direction y, an inclined surface 19, which is a receiving surface which receives the pressing force the locking levers 8 and 9 impart, and a sliding portion 34 which is an inclined surface on which a pushing member 33 integrally formed with the locking lever 8 slides and which causes the head carriage 12 to shift upwardly.

Next, attachment and detachment operations of the head cartridge 12 will be described with reference to FIGS. 4 to 6B. FIGS. 4 to 6B are carriage cross-sectional views for explaining the attachment and detachment operations of the head cartridge 12.

Figure 4:
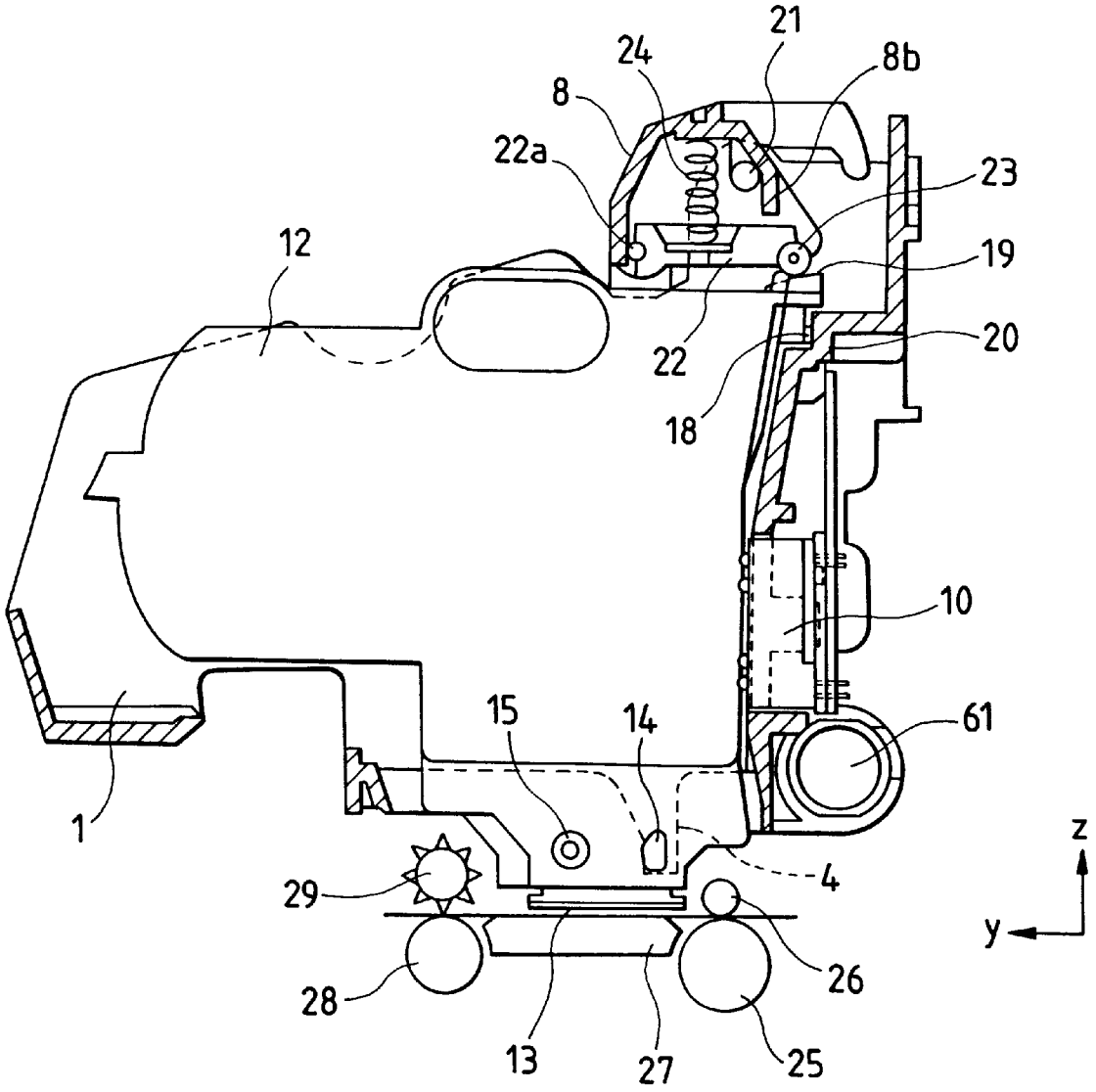
FIG. 4 is a carriage cross-sectional view for explaining the attachment and detachment operations of the head cartridge in the carriage shown in FIG. 2.

FIG. 4 shows a state where the head cartridge 12 is locked at a predetermined position. The positioning protrusion 14 of the head cartridge 12 engages with the positioning groove 4 of the carriage 1, and the abutting portion 18 in the direction y, on the upper portion of the rear surface of the head cartridge, press-contacts a receiving surface 20 of the carriage 1. The connector 10 contacts a contact pad 16*a* at a moderate contact pressure in this state thereby to perform electrical connection. This contact pressure performs the electrical connection and at the same time acts in such a direction that the positioning protrusion 14 is securely pressed against the positioning groove 4, while the contact pressure acts in such a direction that the abutting portion 18 is separated from the receiving surface 20. At a state where the abutting portion 18 in the direction y was separated from the receiving surface 20, the position of the head cartridge 12 becomes unstable, and the position accuracy of the nozzle portion 13 is low, and the electrical connection also becomes unstable. Therefore, it is necessary to press the inclined surface 19 of the head cartridge 12 with power larger than the contact pressure of the connector 10.

The locking lever 8 is rotatable around the fulcrum shaft 21. In the locking lever 8 are incorporated an arm 22 which swings around the fulcrum 22*a*, a press-contacting roller 23 attached to the swinging arm 22, and a press-contacting spring 24 which loads the arm 22. By a manner that the press-contacting roller 23 of the thus formed pressing portion presses the inclined surface 19 of the head cartridge 12, the abutting portion 18 in the direction y and the receiving surface 20 are securely abutted and the positioning protrusion 14 and the positioning groove 4 are abutted in the direction z.

That is, the position in the direction y is determined by the three points of the positioning protrusions 14 (on both sides) and abutting portion 18, the position in the direction z is determined by the two points of the positioning protrusions 14 (on both sides), and the position in the direction x is determined by the one point of the abutting portion 15, thereby to stabilize the position of the head cartridge.

In this example, a pinch roller 26 press-contacting a feed roller 25, a platen 27, and a spur 29, that is a feed rotator, press-contacting a paper discharge roller 28 are placed in the vicinity of the nozzle portion 13. The carriage 1 reciprocates along the guide shaft 61. Thus, in a state where the head cartridge 12 is locked at a predetermined position, no carriage 1 interferes with any elements, normally. Nevertheless, it is preferable that the carriage 1 does not interfere with any elements even in the attachment and detachment of the head cartridge 12.

Figure 5:
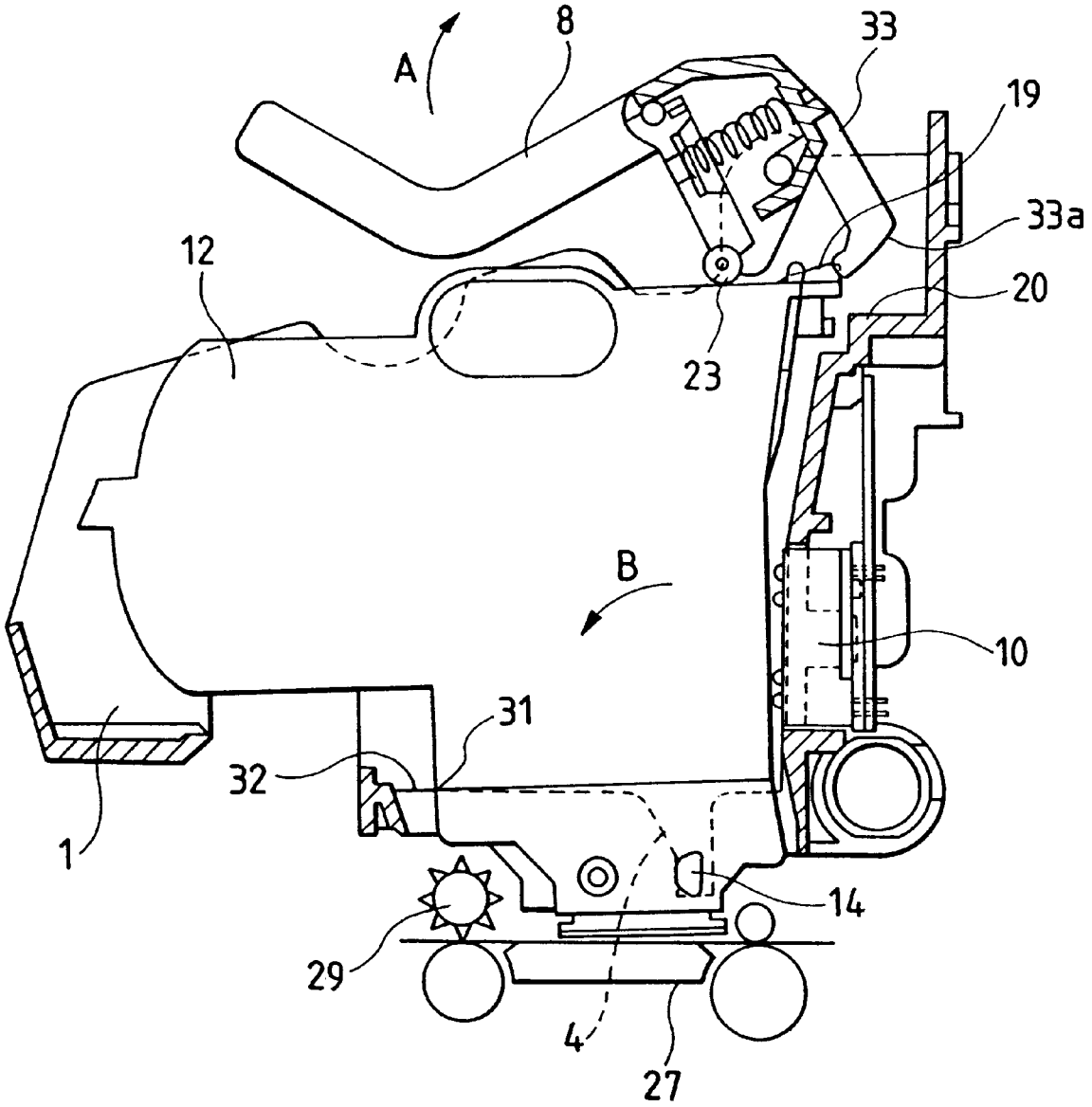
FIG. 5 is a carriage cross-sectional view for explaining the attachment and detachment operations of the head cartridge in the carriage shown in FIG. 2.

In the present embodiment, in a case where the head cartridge 12 is removed, when the head cartridge 12 rises in the direction of an arrow A as shown in FIG. 5, the engagement of the press-contacting roller 23 with the inclined surface 19 is first released. Accordingly, the head cartridge 12 is rotated in the direction of an arrow B using the positioning protrusions 14 on both sides as the fulcrum, by the repulsion force of the connector 10 and the head cartridge's own weight. When the head cartridge 12 is rotated under these conditions, it potentially interferes with the platen 27 and the spur 29. However, in a case of the present embodiment, the auxiliary engagement portion 31 of the head cartridge 12 engages with the auxiliary guide 32 of the carriage 1 to restrict the rotation of the head cartridge 12, resulting in no interference.

When the locking lever 8 is further rotated, the pushing member 33 integrally formed with the locking lever 8 engages with the sliding portion 34 of the head cartridge 12, whereby the head cartridge 12 is pushed along the positioning groove 4 and auxiliary guide 32 of the carriage 1. At this time, the movement of the head cartridge 12 takes such a path as not to interfere with the platen 27 and the spur 29 and the like.

Figure 6B:
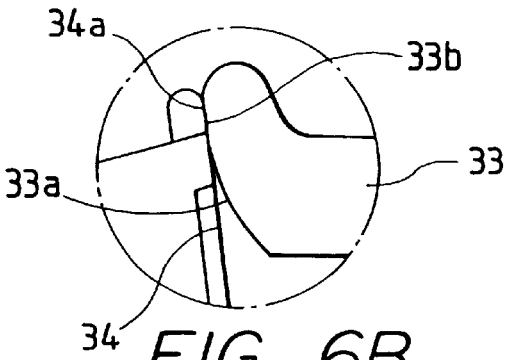
FIG. 6A is a carriage cross-sectional view and FIG. 6B is a partial enlarged view for explaining the attachment and detachment operations of the head cartridge in the carriage shown in FIG. 2.
Figure 6A:
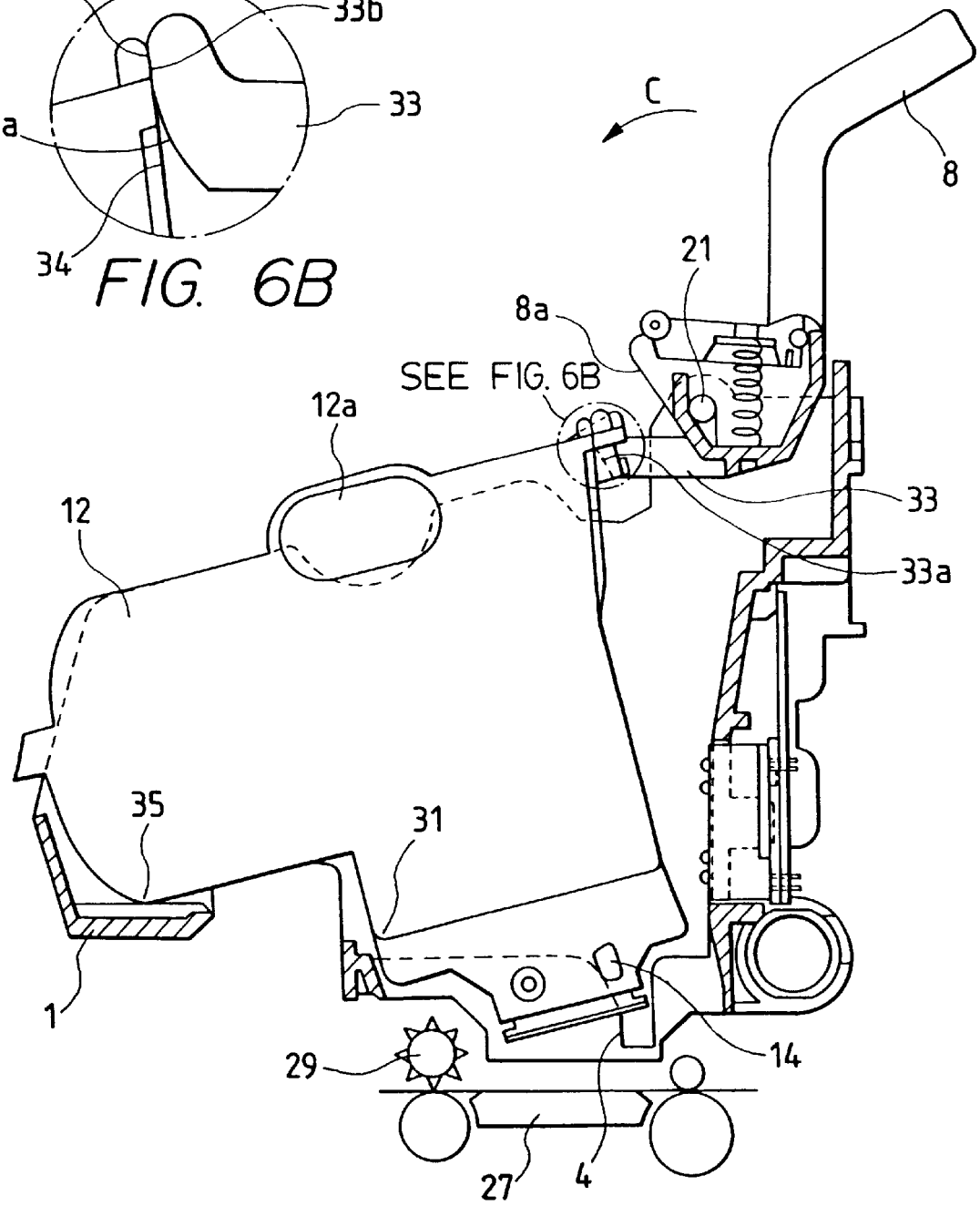

Then, the locking lever is rotated to a moderate position so that the head cartridge 12 may be only pushed to a position where it is easy to remove. However, in the present embodiment, the head cartridge 12 takes such an attitude as shown in FIG. 6 at the replacement position.

That is, when the locking lever 8 is fully rotated, the head cartridge 12 can be held with another auxiliary engagement portion 35, the positioning protrusion 14, and the sliding portion 34 at a stable state. To transfer from the auxiliary engagement portion 35 to another auxiliary engagement portion 35 is to stabilize the balance of the gravity center. Further, by setting the arc portion (circle) 33*a* of the pushing member 33 to be concentric with the fulcrum shaft 21, the reverse rotation of the locking lever 8 in a direction of the arrow C, due to the weight of the head cartridge 12, can be prevented. Additionally, a portion 33*b* of the pushing member 33, which finally engages with the sliding portion 34 when the locking lever 8 is fully rotated has a plane surface. Since the final engagement surface 33*b* of the pushing member 33 engages with an engagement surface 34*a* of the sliding portion 34 with a plane, the head cartridge 12 does not return to the original position and is secured in a state of inclination facing the operator side.

A user can easily replace the head cartridge 12 in this state by grasping the knob portion (operating portion) 12*a* of the head cartridge 12.

When a new head cartridge 12 is reset after the replacement of a used head cartridge, the turn of the locking lever 8 in a direction of the arrow C changes the attitude of the head cartridge 12 with the rotation of the pushing member 33. This change can occur by the head cartridge's own weight.

However, even if the head cartridge 12 is stopped by friction or the like in progress, the head cartridge 12 is forcibly pressed with a cam portion 8*a* of the locking lever 8, to thereby take a state shown in FIG. 5. Thus, setting of the head cartridge 12 is finally completed as shown in FIG. 4.

According to the present embodiment, the head cartridge does not contact the pinch roller 26, the platen 27, and the spur 29, not only in the proper setting state of the head cartridge, but also during the attachment and detachment operations. Therefore, the device is not broken by the replacement of a cartridge irrespective of the position of the carriage 1. Further, since it is not necessary to provide a concave relief portion in the platen 27, no deterioration of images occurs because of enlargement of waving of a recording paper.

That is, according to the present invention, an ink jet recording apparatus having a simple configuration, an excellent operability, and the above-mentioned effects can be provided.

Incidentally, as described above, in the present embodiment a carriage in which two head cartridges can be set was used as an example. However, it is natural that even a carriage in which one head cartridge or two or more head cartridges can be set may be also used.

An example of a head cartridge 12 including a positioning protrusion 14, and an example of a carriage 1 including a positioning groove 4 were explained. To the contrary, the head cartridge may include a positioning groove, and the carriage may include a positioning protrusion.

Further, an ink jet recording apparatus in the present embodiment is formed such that a head cartridge is secured through the press-contacting roller 23.

This is because the operating force of the locking lever 8 is decreased. Thus, a round shape portion is formed on the swinging arm 22 in place of the press-contacting roller, whereby the inclined surface 19 of the head cartridge 12 may be pressed.

(Second Embodiment)

Figure 7:
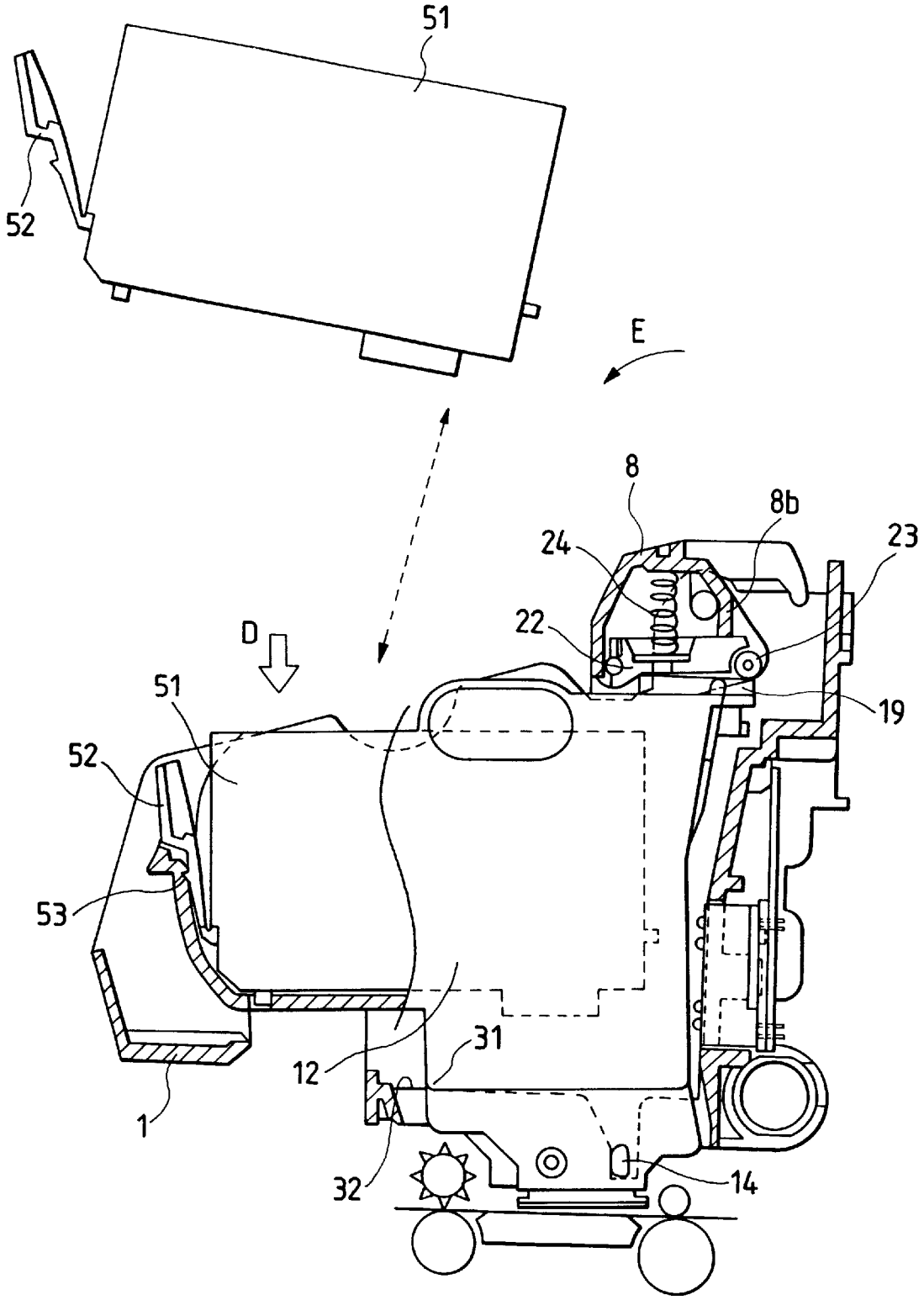
FIG. 7 is a carriage cross-sectional view for explaining another example of a head cartridge which can be applied to a carriage of an ink jet recording apparatus of the present invention.

FIG. 7 is a carriage cross-sectional view for explaining another example of a head cartridge which can be applied to a carriage of an ink jet recording apparatus of the present invention. In the following descriptions of the second embodiment, the same components as in the first embodiment are denoted by the same reference numerals and the descriptions thereof are omitted.

The configuration of the second embodiment shown in FIG. 7 is different from the first embodiment only in that an ink tank 51 is detachably formed in a head cartridge 12 which functions as a head holder.

That is, if the ink tank became empty of ink, a user replaces only the ink tank 51 while keeping a secured state of the head cartridge 12 shown in FIG. 4.

The user usually detaches a used ink tank from the head cartridge 12, and pushes a hook 52 of a new ink tank in a direction D in FIG. 7 to an extent that the hook 52 of the new ink tank is fitted into a groove 53 provided in the head cartridge 12. However, the head cartridge 12 which should be properly secured is potentially detached from the original position by this pushing force, and the head cartridge must be often reset with every replacement of the ink tank.

However, in the present embodiment, if a force in the direction D is applied, the head cartridge 12 is rotated using the positioning protrusion 14 as a fulcrum. On the other hand, the locking lever 8 in the state of FIG. 7 is not rotated further in a direction of arrow E by a stopper (not shown). Thus, an inclined surface 19 displaces a swinging arm 22 in such a direction that a press-contacting spring 24 is further compressed. Then, before releasing the engagement of the inclined surface with the press-contacting roller 23, the swinging arm 22 abuts on the stopper 8*b* of the locking lever 8. Thus, the detachment of the press-contacting roller 23 from the inclined surface 19 can be prevented. Additionally, at substantially the same time when the swinging arm 22 abuts on the stopper 8*b*, an auxiliary engagement portion 31 of the head cartridge 12 engages with an auxiliary guide 32 of the carriage 1. Accordingly, the rotation of the head cartridge 12 using the positioning protrusion 14 as the fulcrum can be securely stopped. That is, even if a large operating force is applied to the head cartridge 12 during the replacement of the ink tank 51, the head cartridge 12 merely floats just a little and is not detached. Then, the hook 52 of the ink tank 51 is fitted into the groove 53 of the head cartridge 12. Thus, when a user moves his hand off the cartridge, the head cartridge 12 returns to such a properly secured state as shown in FIG. 4 by a loading force of the press contacting spring 24.

According to the configuration described above, when only an ink tank is replaced in a head cartridge-secured state, the detachment of the head cartridge by the attachment and detachment operating forces of the ink tank can be prevented. Therefore, the operability of the ink jet recording head is enhanced.

Incidentally, in the present embodiment, the floating of the head cartridge 12 was restricted with the stopper 8*b* and auxiliary engagement portion 31. However, sufficient effects can be obtained only with the auxiliary engagement portion 31 without providing the stopper 8*b*.

According to the present examples described above, such effects can be obtained that an ink jet recording apparatus is not damaged even if the replacement of a cartridge is performed anywhere irrespective of the position of a carriage, by providing an auxiliary engagement portion which contacts during attachment and detachment operations to restrict the attachment and detachment locuses, other than positioning portions which position a carriage and a cartridge, in both the carriage and head cartridge, and by providing a pushing member which pushes a head cartridge in accordance with the rotation for a removal of securing a locking lever, and that a deterioration of images, which are generated by providing a platen with a needless relief portion, does not occur. Additionally, an ink jet recording apparatus which has a simple configuration and an excellent operability can be provided.

Further, according to the present examples, in providing an ink tank-replaceable head cartridge, an auxiliary engagement portion which prevents a head cartridge from being rotated by an operating force for attaching the ink tank without limitation, using a positioning portion as a fulcrum, is provided in both the head cartridge and carriage. Accordingly, such an effect can be obtained that a secured head cartridge is not removed during the replacement of an ink tank and the device has an excellent operability.

What is claimed is:

1. A recording apparatus comprising:

a carriage for detachably holding a head cartridge for discharging liquid ink droplets to record, the head cartridge having cartridge positioning portions on both sides thereof and an inclined surface on a rear portion of an upper surface thereof, and further includes a detachable ink tank, said carriage having carriage positioning portions for engaging with the cartridge positioning portions on both sides of the head cartridge, and having a locking lever which is rotatable about the upper surface of the head cartridge and securing the head cartridge within said carriage by pressing the inclined surface in accordance with rotation of said locking lever in a forward direction, wherein an auxiliary engaging section is provided on the head cartridge or said carriage so as to limit free rotation of the head cartridge about said carriage positioning portions by an operational force when the ink tank is mounted in a state with the head cartridge being mounted on said carriage by said locking lever, and wherein said locking lever comprises a swinging arm loaded with a press-contacting spring, a portion of said swinging arm pressing the inclined surface during the operation of securing the head cartridge, and a stopper portion which restricts the rotation of the head cartridge using the cartridge positioning portions of the head cartridge as a fulcrum by the abutment of said swinging arm at substantially the same time when an auxiliary engagement section of the head cartridge contacts an auxiliary engagement section of said carriage.

2. A recording apparatus comprising:

a carriage for detachably holding a cartridge having cartridge positioning portions on both sides thereof and an inclined surface on a rear portion of an upper surface thereof, said carriage having carriage positioning portions for engaging with the cartridge positioning portions on both sides of said cartridge, and having a locking lever which is rotatable about the upper surface of the cartridge and secures the cartridge within said carriage by pressing the inclined surface in accordance with rotation of said locking lever in a forward direction, wherein said locking lever is provided with a pushing member for dislodging the cartridge by pushing the upper portion of the rear surface of the cartridge in accordance with rotation of said locking lever in a reverse direction, and wherein an auxiliary engaging section is provided on the cartridge or said carriage so as to rotate the cartridge around said carriage positioning portions when said cartridge is removably attached and to limit contact of the cartridge in attachment and detachment paths of the cartridge when the cartridge is removably attached.

3. A recording apparatus according to claim 2, wherein said pushing member is integrally formed with said locking lever.

4. A recording apparatus according to claim 2, wherein a portion of said pushing member has an arc shape concentric with a rotating fulcrum shaft of said locking lever.

5. A recording apparatus comprising:

a carriage for detachably holding a head cartridge for discharging liquid ink droplets to record, the head cartridge having cartridge positioning portions on both sides thereof and an inclined surface on a rear portion of an upper surface thereof, and further includes a detachable ink tank, said carriage having carriage positioning portions for engaging with the cartridge positioning portions on both sides of the head cartridge, and having a locking lever which is rotatable about the upper surface of the head cartridge and securing the head cartridge within said carriage by pressing the inclined surface in accordance with rotation of said locking lever in a forward direction, wherein an auxiliary engaging section is provided on the head cartridge or said carriage so as to limit free rotation of the head cartridge about said carriage positioning portions by an operational force when the ink tank is mounted in a state with the head cartridge being mounted on said carriage by said locking lever.

6. A recording apparatus comprising:

a carriage for detachable holding a cartridge having cartridge positioning portions on both sides thereof and an inclined surface on a rear portion of an upper surface thereof, said carriage having carriage positioning portions for engaging with the cartridge positioning portions on both sides of the cartridge, and having a locking lever which is rotatable about the upper surface of the cartridge and securing the cartridge within said carriage by pressing said inclined surface in accordance with rotation of said locking lever in a forward direction, wherein said locking lever is provided with a pushing member for dislodging the cartridge by pushing the upper portion of the rear surface of the cartridge in accordance with rotation of said locking lever in a reverse direction, and wherein said locking lever is fully rotated in the reverse direction so that the cartridge is held in a stable state by said carriage and said locking lever.

7. A recording apparatus according to claim 6, wherein said pushing member is integrally formed with said locking lever.

8. A recording apparatus according to claim 6, wherein a portion of said pushing member has an arc shape concentric with a rotating fulcrum shaft of said locking lever.

9. A recording apparatus comprising:

a carriage for detachably holding a cartridge having cartridge positioning portions and an inclined surface on a rear portion of an upper surface thereof, said carriage having carriage positioning portions for engaging with the cartridge positioning portions of said cartridge, and having a locking lever which is rotatable about the upper surface of the cartridge and secures the cartridge within said carriage by pressing the inclined surface in accordance with rotation of said locking lever in a forward direction, wherein said locking lever is provided with a pushing portion for dislodging the cartridge by pushing the upper portion of the rear surface of the cartridge in accordance with rotation of said locking lever in a reverse direction, and wherein an auxiliary engaging section is provided on the cartridge or said carriage so as to rotate the cartridge around said carriage positioning portions when said cartridge is removably attached and to limit contact of the cartridge in attachment and detachment paths of the cartridge when the cartridge is removably attached.

10. A recording apparatus comprising:

a carriage for detachably holding a head cartridge for discharging liquid ink droplets to record, the head cartridge having cartridge positioning portions and an inclined surface on a rear portion of an upper surface thereof, and further includes a detachable ink tank, said carriage having carriage positioning portions for engaging with the cartridge positioning portions of the head cartridge, and having a locking lever which is rotatable about the upper surface of the head cartridge and securing the head cartridge within said carriage by pressing the inclined surface in accordance with rotation of said locking lever in a forward direction, wherein an auxiliary engaging section is provided on the head cartridge or said carriage so as to limit free rotation of the head cartridge about said carriage positioning portions by an operational force when the ink tank is mounted in a state with the head cartridge being mounted on said carriage by said locking lever.

11. A recording apparatus comprising:

a carriage for detachably holding a cartridge having cartridge positioning portions and an inclined surface on a rear portion of an upper surface thereof, said carriage having carriage positioning portions for engaging with the cartridge positioning portions of the cartridge, and having a locking lever which is rotatable about upper surface of the cartridge and securing the cartridge within said carriage by pressing said inclined surface in accordance with rotation of said locking lever in a forward direction, wherein said locking lever is provided with a pushing portion for dislodging the cartridge by pushing the upper portion of the rear surface of the cartridge in accordance with rotation of said locking lever in a reverse direction, and wherein said locking lever is fully rotated in the reverse direction so that the cartridge is held in a stable state by said carriage and said locking lever.

* * * * *

UNITED STATES PATENT AND TRADEMARK OFFICE

CERTIFICATE OF CORRECTION

PATENT NO. : 6,312,105 B1
DATED : November 6, 2001
INVENTOR(S) : Miyauchi

It is certified that error appears in the above-identified patent and that said Letters Patent is hereby corrected as shown below:

Column 1,
Line 16, "Press-contacting" should read -- press-contacting --.
Line 50, "head a" should read -- a head --.
Line 51, "mechanisms with does" should read -- mechanism which does --.

Column 4,
Line 3, "a" should read -- an -- and "an" should read -- a --.

Column 5,
Line 53, "head" should read -- new head --.

Signed and Sealed this

Second Day of April, 2002

*Attest:*

*Attesting Officer*

JAMES E. ROGAN
*Director of the United States Patent and Trademark Office*